US008585453B2

(12) United States Patent
Doyle

(10) Patent No.: US 8,585,453 B2
(45) Date of Patent: Nov. 19, 2013

(54) TECHNICAL AID SWIMMING HAND PADDLES

(75) Inventor: Joseph Gordon Doyle, Greenwood, IN (US)

(73) Assignee: Joseph Gordon Doyle, Greenwood, IN (US)

( * ) Notice: Subject to any disclaimer, the term of this patent is extended or adjusted under 35 U.S.C. 154(b) by 163 days.

(21) Appl. No.: 13/176,710

(22) Filed: Jul. 5, 2011

(65) Prior Publication Data

US 2012/0009833 A1 Jan. 12, 2012

Related U.S. Application Data

(60) Provisional application No. 61/399,170, filed on Jul. 7, 2010.

(51) Int. Cl.
*A63B 31/10* (2006.01)

(52) U.S. Cl.
USPC ..... 441/58

(58) Field of Classification Search
USPC ..... 441/55, 56, 58–60
See application file for complete search history.

(56) References Cited

U.S. PATENT DOCUMENTS

| | | | | |
|---|---|---|---|---|
| 91,300 | A | | 1/1869 | Barnett |
| 183,045 | A | | 10/1876 | Dunlop |
| 1,192,650 | A | | 7/1916 | Leitner |
| 1,395,914 | A | | 11/1921 | Grundmann |
| 1,541,100 | A | | 6/1925 | Barrett |
| 1,663,328 | A | | 3/1928 | Arnold |
| 1,708,331 | A | * | 4/1929 | Ryan ..... 441/58 |
| 1,821,974 | A | * | 9/1931 | Leblanc ..... 441/59 |
| 2,017,463 | A | | 10/1935 | Komadina |
| 2,159,972 | A | | 5/1939 | Larson |
| 3,397,414 | A | | 8/1968 | Webb |
| 3,619,914 | A | * | 11/1971 | Hanson et al. ..... 36/118.4 |
| 3,765,042 | A | | 10/1973 | Montrella |
| 3,789,447 | A | | 2/1974 | Lavallee |
| 4,220,284 | A | * | 9/1980 | Beiswenger et al. ..... 239/242 |
| 4,493,663 | A | | 1/1985 | Richmond |
| 4,756,699 | A | * | 7/1988 | Brom ..... 441/59 |
| 4,913,418 | A | | 4/1990 | Schlueter |
| 5,147,233 | A | | 9/1992 | Hannula |
| 5,288,254 | A | | 2/1994 | Elson |
| 5,511,998 | A | | 4/1996 | Johnson |
| 5,651,710 | A | | 7/1997 | Rives |
| 7,179,146 | B2 | | 2/2007 | Johnson |
| 7,614,928 | B2 | * | 11/2009 | Grivna ..... 441/61 |
| 2002/0078529 | A1 | * | 6/2002 | Schwarz ..... 16/387 |

* cited by examiner

*Primary Examiner* — Stephen Avila

(57) ABSTRACT

Disclosed is a unique concept of a handheld swimming paddle containing a pivoting member with an attached angled section, which provides instant resistive and visual feedback when a swimming stoke is not properly executed. Such feedback allows the unique paddle to act as a technical aid for all levels of swimmers, as well as a device to build the correct muscles required to swim with proper stroke mechanics through constant monitoring. The disclosed invention will introduce resistance that will impede the swimmer's forward progress only when a pull is not properly executed, which means that it will be easier for the swimmer to execute a full proper stroke rather than swim with poor mechanics. Additionally, the disclosed invention will assist in the proper hand placement and orientation at the beginning of the stroke.

12 Claims, 4 Drawing Sheets

TECHNICAL AID SWIMMING HAND PADDLES

FIELD OF INVENTION

This invention relates, but is not limited to the field of swimming and, more particularly, swimming hand paddles, which enhance the technical awareness of the swimmer's pulling motion, while also assisting in proper hand position during the 'catch' or beginning portion of a stroke.

BACKGROUND OF INVENTION

Swimmers have a long standing history with hand paddles which are primarily used to increase the pulling resistance of the stroke to enable the swimmer to move more quickly through the water, and as a byproduct, build back, shoulder, and arm muscles. In addition to muscle growth, proper technique is the other main contributor to increasing a swimmer's speed in the water. Previously patented paddles such as, U.S. Pat. No. 4,913,418, U.S. Pat. No. 7,179,146, U.S. Pat. No. 5,147,233, U.S. Pat. No. 5,511,998, have focused on contouring the hand paddle so that the swimmer's hand is properly positioned and/or use apertures to increase the feel of the water to encourage proper technique and hand awareness during a stroke. Most hand paddles comprise of one rigid structure that conforms and attaches to the hand in a variety of ways, but does not actively react to how the hand moves in the water. Other hand paddles such as U.S. Pat. No. 1,541,100, U.S. Pat. No. 2,017,463, U.S. Pat. No. 1,708,331, U.S. Pat. No. 1,663,328, have been designed to incorporate a moving or pivoting component that actively reacts to the relative water flow with respect to the swimmer's hand or foot. Such paddles with a moving or pivoting component focus on an underwater recovery where the moving component is used as a tool to increase the pulling resistance of the swimmer yet enter a lower state of resistance during the underwater recovery to enable the swimmer to move through the water more quickly.

Throughout the development of swimming stroke mechanics, it is widely accepted that a swimmer's palm must be perpendicular to the direction of travel and pressing water in the rearward direction. If the swimmer ceases to press water in the rear direction while the hand is still in the water, then the swimmer is not increasing his or her body speed in the desired direction. If the swimmer's hand becomes non-perpendicular to the overall direction of travel, then the swimmer will essentially be decreasing the amount of resistance at which he or she is able to push the water backwards. These two basic principles are widely accepted by anyone that is skilled in the art, yet executing those technical principles on a consistent basis is challenging. Due to the onset of fatigue, swimmers will cease to press the water rearwards after the hand moves past the shoulder and the swimmer may also rotate his or her palm to decrease the amount of water that is captured by the hand pulling motion and in return reduce the stress on the arm, shoulder and back muscles. The swimmer may also pause or glide the hand near the surface of the water at the beginning of the stroke to incorporate a resting period within a stroke. In the forward gliding state, the palm is not perpendicular to the desired direction of travel which means that the hand is not being utilized for the forward propulsion of the stroke. A swimmer must quickly position his or her hand so that it is perpendicular to the direction of travel and continuously press water to the rear of the stroke until the hand exits the water.

Swimmers often have a difficult time determining his or her hand position during the stroke because of the inability to feel or see what his or her hand is doing at the back of the pulling stroke. Often a swimmer will believe that he or she is pushing water throughout the entire pulling stroke, but rather the hand is not maintaining the pressure required and often exits the water prior to a full stroke. Video analysis and coaching are used to address issues similar to this, but each method results in a delay between the action and the notification to the swimmer.

Accordingly, it is the objective of the invention to provide real time physical and visual feedback to the swimmer and observers, if proper stroke technique is not being executed for any type of swimming that relates to the use of a swimmer's hands propelling the body forward.

Another objective of the invention is to address proper hand orientation relative to the path at which the hand is pulling during the stroke.

It is yet another objective of the invention to encourage a proper hand position at the beginning of the pulling stroke so that the hand is positioned perpendicular to the direction of travel.

It is a further objective of the invention to provide the ability to indicate the onset of fatigue during a swim by notifying the swimmer instantly when his or her stroke begins to deteriorate.

BRIEF SUMMARY OF THE INVENTION

The disclosed invention is a hand paddle to be used by a swimmer as a technical aid for hand awareness and orientation in the water. The device comprises of a top member that contains an upper surface which is where the hand is placed and an opposing lower surface. The device also includes a flap member which is comprised of a bottom surface, and a top surface which faces towards the bottom surface of the top member. The flap member also contains an integrated angled section that can be featured in any orientation on any edge of the flap member. The angled section contains a top surface which faces towards the top member at any nominated angle, and also contains an opposing bottom surface. The said flap member, containing the angled section, pivots about a joint line that is created between the top surface of the flap member and the bottom surface of the top member. The pivot point is located, but it not limited to, the forward section of the bottom surface of the top member, allowing the flap member to open and close against the top member.

The said angled section is utilized to initiate the movements of the flap member relative to the top member. The flap member will pivot towards the bottom surface of the top member when the water pressure on the bottom surface of the flap member and bottom surface of the angled section is greater than the instant water pressure on the top surface of the flap member and top surface of the angled section. Adversely, the angled section will initiate the flap member to pivot away from the bottom surface of the top member when the water pressure on the top surface of the angled section and top surface of the flap member is greater than the instant water pressure on the bottom surface of the flap member and the bottom surface on the angled section. As the flap member departs from the bottom surface of the top member, the maximum angle or distance at which the flap member can depart is, but not required to be, restricted by a band or cover piece attached between the top and bottom members. In addition to a restrictive device (band or cover piece), side rail supports are included to aid in the side to side stability of the pivoting flap member.

Greater explanation can be found in the detailed description of the invention, in view of the fact that an optional system configuration has been selected to provide reference to key features found on the disclosed technical swimming aid. Orientation and location of such features are described to build a greater understanding on how the system operates rather than limit the system design.

BRIEF DESCRIPTION OF THE DRAWINGS

Referenced features of disclosed invention are described in FIGS. 1-8.

DETAILED DESCRIPTION OF THE INVENTION

Figure 1:
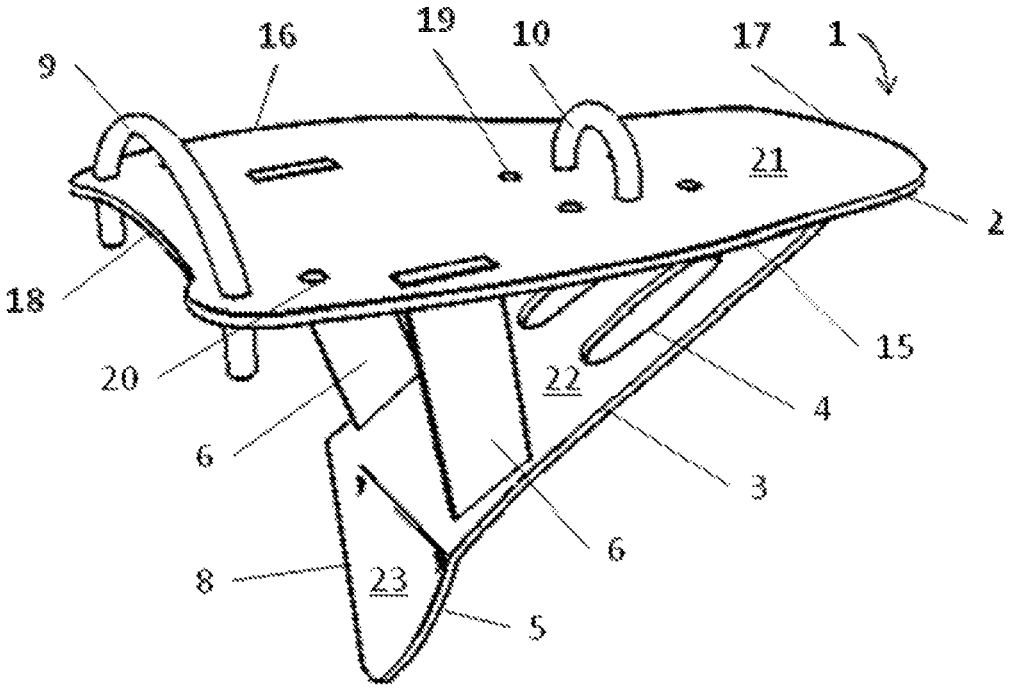
FIG. 1 is a perspective view of the right hand paddle with the flap member in the deployed state including finger and wrist straps and a restrictive band.

The invention herein describes a unique concept of a hand-held swimming paddle that has the ability to offer strength and endurance benefits in addition to encouraging the execution of a consistent, technically correct swimming 'pull stoke', refereed herein as 'pull', through the water. The disclosed hand paddle provides minimal resistance to a swimmer's pull when executed correctly and will noticeably impede the swimmer's forward movement when a swimmer's 'pull' is not correctly executed.

FIGS. 1, 4, 7, 8 illustrate the assembly 1 in the deployed state 28. The deployed state 28 refers to when the angle between the top member 2 and the flap member 3 has reached the maximum angle allowed by the restrictive band 6 or another type of restricting device. FIGS. 2, 3, 5, 6 illustrate the assembly 1 in the closed state 27 which refers to when the flap member 3 is parallel to the top member 2. The top member 2 contains a top surface 21, bottom surface 24, leading edge 17, aft edge 18, outside edge 15, inside edge 16, and apertures 19, 20 which are for the finger band 10 and wrist band 9, respectively. The finger band 10 and wrist band 9 are used to secure the swimmer's hand to the paddle; such bands are made of resilient surgical tubing, elastomeric polymer, or any like material. The restrictive band 6 may be made of rubber, polymer or any like material containing any range of elasticity; the strap must also have the ability to bend and fold with ease. The flap member 3 departs freely from the top member 2 until the restrictive band 6 reaches a state of tension and restricts further movement of the flap member 3.

The flap member 3 is adjacent to an angled section 5. The angled section 5 may be attached to any surface or edge of the flap member 3, but for clarity and consistency the angled section 5 is attached along the angled section leading edge 37 and the flap member aft edge 33. The flap member 3 and the angled section 5 are made, but not required to be, of the same piece of material and formed into shape. When the angled section 5 is adjacent to the aft end of the flap member 33, the angled section 5 should favor, but is not limited to, the outside edge 15 so that the swimmer does not contact the angled section 5 while in the streamline position, which describes when a swimmer's hands are on top of each other and above the swimmer's head in a forward stretching position. Angled section 5 contains, but is not required to have, an angled or non-symmetric edge 8 to additionally aid in the comfort of the swimmer in the streamline position. Angled section 5 can either contain two parallel planer surfaces or contain one or more curved surfaces as long as the said angle section 5 is conducive to the sensitivity of incorrect hand movements in the water.

The flap member 3 contains apertures 4 which should be present when finger and wrist apertures 19 and 20 have limited backside access due to the presence of the flap member 3 or the angled section 5, in which case the access apertures 4 are located directly under the obstructed finger or wrist apertures 19, 20. The access apertures 4 should be larger than apertures 19 and 20 and also larger than the wrist band 9 and finger band 10 as to provide easy access to apertures 19 and 20 and not cause contact as flap member 3 pivots.

On the bottom surface of the top member 24, rail supports 11, 12 are used to assist in the guidance of the flap member 3 by limiting side to side movement. Support rails can range from protruding ridges from bottom surface 24 as shown in FIGS. 2, 3, 4, 5, 6, 7, 8 or even an indented region in bottom surface 24. The joint configuration which provides a pivoting joint for flap member 3, may be integrated into the rail supports 11, 12. The aforementioned joint may be as simple as a 'pin in hole' joint. Alternatively, the hinge joint may be integrated into the system in a way which the joint, itself, provides a constraining force which restricts further deployment of the flap member 3 past the maximum angle. Additionally, the hinge joint could contain a spring or like device that provides a force that resists the flap member 3 from deploying past the maximum angle. A spring or like device may also be integrated into the disclosed invention to incorporate an active joint which provides a closing force that aids in the flap member 3 returning to the closed state which is parallel to the bottom surface of the top member 24.

Figure 6:
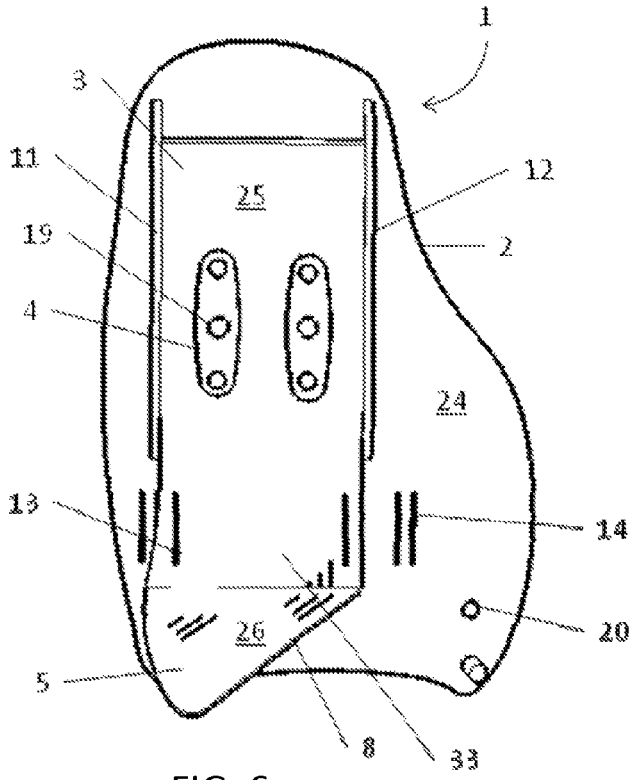
FIG. 6 is a bottom view of the right hand paddle with the flap member in the closed state, depicting the relative location of the flap member and angled section to the top member.
Figure 7:
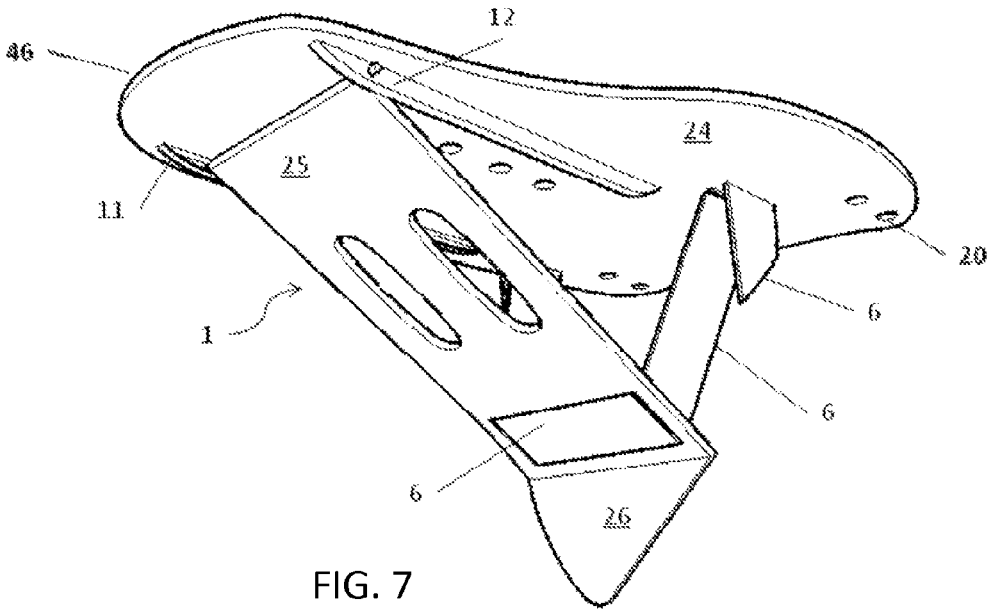
FIG. 7 is a perspective view of the right hand paddle with the flap member in the deployed position, while illustrating the rail supports and the restrictive band that limits the flap member from departing past maximum angle.
Figure 8:
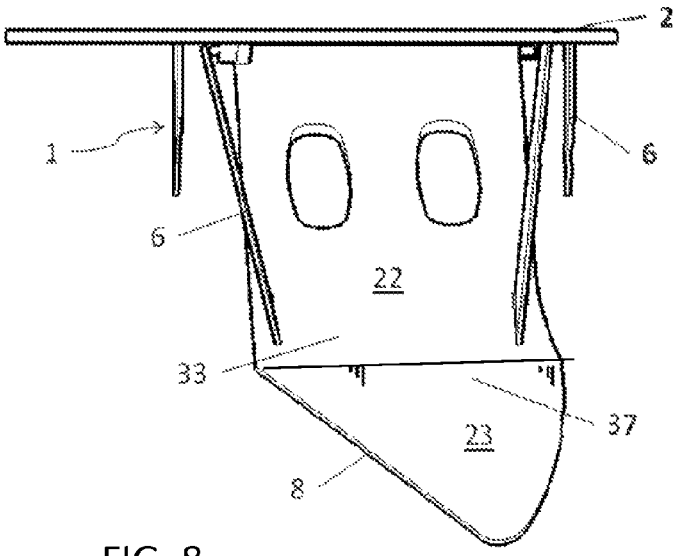
FIG. 8 is a rear view of the right hand paddle with the bottom flap member in the fully deployed state and restrictive band under a state of tension.

Thin elongated apertures 13, 14 are illustrated in FIG. 6 to show one method of securing the restrictive band 6 to the top member 2 and flap member 3. The restrictive band 6 may consist of a single band that is wound through a series of thin elongated apertures 13, 14 so that it is securely tightened and can withstand the forces which will cause the flap member 3 to depart. Additionally, the restrictive band 6 may be adjusted as to accommodate various maximum angles to which the flap member 3 may depart from the top member 2. The maximum departure angle of the flap member 3 directly correlates to the amount of resistance that impedes the swimmer's forward movement when the flap member 3 is in the deployed state. Smaller maximum angles will introduce a slight resistance while angles approaching ninety degrees will introduce a larger amount of resistance to the swimmer's forward progress.

Figure 2:
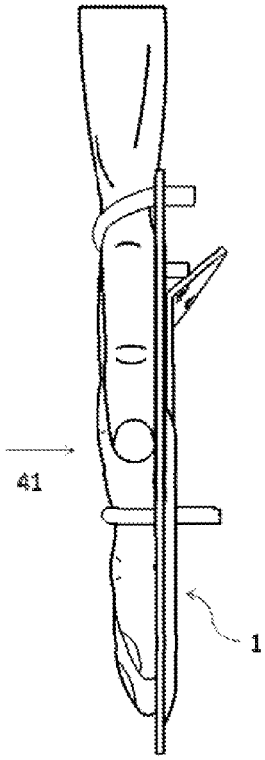
FIG. 2 is a side view of the right hand paddle as the hand moves perpendicular to the surface of the palm causing the flap member to be in the closed state.

FIG. 2 demonstrates the right hand moving perpendicular to the palm of the hand 41 which is one of the scenarios which will generate a greater sum of forces on bottom surface of flap member 25 and bottom surface of angled section 26 compared to the top surface of flap member 22 and top surface of angled section 23 which will result in the flap member 3 to be parallel and adjacent to the bottom surface of top member 24. In general, a large amount of water pressure on the palm of the hand as it moves rearward in the stroke strongly correlates to maximum forward body propulsion and is the base principle of a properly executed stroke. The pressure on the palm of the hand should initiate at the front or catch of a stroke and shall maintain or increase the palm water pressure until the hand exits the water. If a swimmer is able to execute a proper pull in the water to which the palm consistently applies a large amount of pressure, then the disclosed invention 1 with not introduce additional resistance to impede the swimmer's forward movement and the assembly 1 will act as a traditional single element hand paddle.

Figure 3:
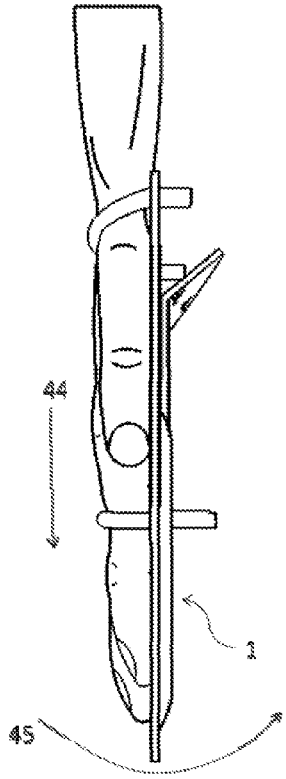
FIG. 3 is a side view of the right hand paddle as the hand moves forward, parallel to the surface of the palm, causing the flap member to be in the closed state while also creating a pivoting or rotating force on the hand about the angled section.

FIG. 3 illustrates the right hand moving in the direction of the fingertips and parallel to the palm of the hand 44 which will generate a high amount of water pressure primarily on the bottom surface of angle section 26 and cause the flap member 3 to be parallel and adjacent to surface 24 and also provide a pivoting motion of the fingertips towards the hand paddle 45. Hand motion 44 directly relates to the hand entering the water at the front of the stroke which is referred to as the beginning or 'catch' of the swimming stroke. When the swimmer executes this motion, he or she will experience a slight tilting motion which will assist the swimmer in positioning his or her hand into a proper catching position at the top of the stroke.

Figure 4:
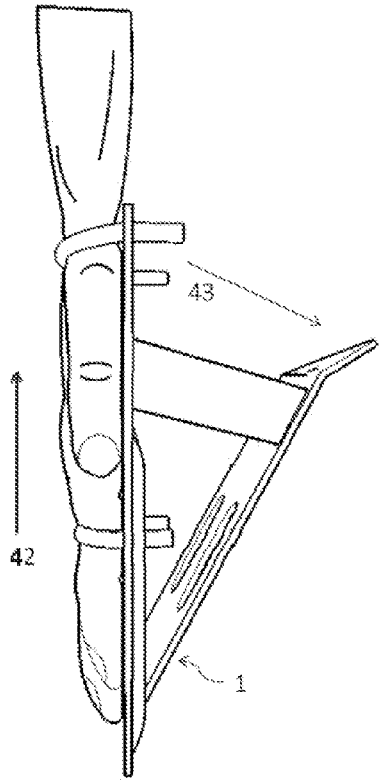
FIG. 4 is a side view of the right hand paddle as the hand moves rearwards, parallel to the surface of the palm, causing the flap member to be in the deployed and resistive state.
Figure 5:
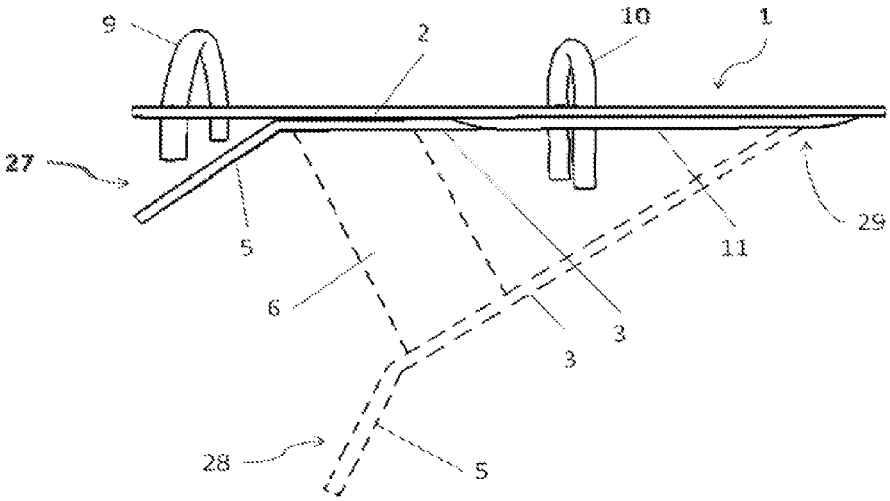
FIG. 5 is a side view of the right hand paddle with the flap member in the closed state while dotted features illustrate the flap member in deployed state while the restrictive band limits further pivoting; finger and wrist straps are depicted for clarity.

FIGS. 4, 5 illustrate how the flap member 3 departs or pivots away from the top member 2. FIG. 4 demonstrates the right hand moving parallel to the palm of the hand in the direction of the wrist 42 which will generate a greater sum of forces to the top surface of the flap member 22 and the top surface of the angled section 23 compared to the instant water pressure on the bottom surface of the flap member 25 and bottom surface of the angled section 26 resulting in the flap member departing 43 and becoming non-parallel to the bottom surface of the top member 24. Hand movement in the direction of the wrist, is not a valuable movement with respect to a proper pulling motion due to the hand being submerged in the water yet not providing a maximum forward thrust. The resulting assembly movement 43 will provide a sudden increase in resistance which will impede the swimmer's forward movement and, in return, alert the swimmer that his or her hand is not executing a technically correct stroke. Additionally, there is a visual benefit by having the mating surfaces of the flap member 3 and top member 2 be a different color than the rest of the hand paddle. Such contrast will aid an observer in distinguishing if the flap member 3 departs from the top member 2.

Although not illustrated in this document, the angled section 5 and the pivot joint 29 may be positioned in various orientations relative to the top member 2. With the ability to move the angled section 5 and pivot joint 29 to other locations, disclosed hand paddles 1 may be designed to identify any particular hand movement in the water by introducing resistance when the desired hand movement occurs yet acting as a traditional swimming hand paddle when the stroke is executed properly. To increase the longevity of the pivot joint, the pivot joint is not to be positioned on the leading or finger tip edge 17 of the top member 2 to avoid repetitive collisions to a rigid surface or wall. A noteworthy comment about the design of the disclosed hand paddle 1 is that the left hand paddle and right hand paddle are minor images of each other; which is an obvious relation to someone who is skilled in the art. The top member 2 and flap member 3 and all rigidly attached features will be made of a mostly rigid and impact resistant thermoplastic resin or like material with an estimated thickness of up to 4 mm.

Swimmers will have the ability to use a wide range of hand paddle sizes. Disclosed hand paddles 1 that are the same size or smaller than the swimmer's hands will be used for learning and building the muscles required to swim with a proper stoke, yet may also be used for race pace swimming in which the swimmer would like to have a fast arm cadence while still properly executing a stroke. More experienced swimmers may use the disclosed hand paddles 1 that are larger than the user's hands to put more stress on the arm, shoulder, and back muscles resulting in those muscles groups becoming stronger and more developed.

It is valuable information to know when a swimmer begins to lose stroke technique during a race. Such knowledge can be obtained by swimming at race speed with the disclosed hand paddles 1. The swimmer will not feel any resistance while he or she is maintaining proper technique, but will suddenly experience a noticeable increase in the amount of resistance to his or her forward progress once the technique begins to degrade. As the swimmer continues to use the disclosed hand paddles 1, he or she will be able to extend the distance to which proper technique can be executed. Additionally, the swimmer will develop muscle memory of a properly executed stroke which will translate into faster swimming during a race by maintaining proper technique over a longer distance.

Persons skilled in the art will recognize that many variations and modifications are possible in the details, materials, and arrangements of the parts and actions which have been described and illustrated. It is to be understood that such embodiments are merely illustrative and do not limit the scope or spirit of the invention as defined by the appended claims.

What is claimed is:

1. A swimming hand paddle for use by a swimmer within a body of water; said swimming hand paddle comprising: a top member with a finger end and a wrist end to which the swimmer's hand rests and is secured via hand constraining elements which secure at least one finger to the top member; a pivoting member having a main body which is located near the non-hand surface of said top member and which attaches at one end to said finger end of the top member; said pivoting member includes an angled section at the other end of said pivoting member main body; said angled section does not share the same planar orientation as said pivoting member main body; said top member contains an inner edge which the swimmer's thumb rests and an outer edge which the swimmer's little finger rests and a center line which separates the inner half from the outer half of the top member; said pivoting member main body and said angled section are positioned and designed to favor said outer edge of top member such that pivoting member main body and angled section do not interfere with swimmer's opposite hand or wrist when one hand is on top of the other such as during streamlining; the center points of the areas of said pivoting member main body and said angled section are both on the said outer edge side of said top member center line.

2. The swimming hand paddle of claim 1 which said angled section is a curved surface opposed to a planar feature.

3. A swimming hand paddle for use by a swimmer within a body of water; said swimming hand paddle comprising: a top member with a finger end and a wrist end to which the swimmer's hand rests and is secured via hand constraining elements which secure at least one finger to the top member; said top member contains hand constraining element apertures which are used to constrain said hand constraining elements; a pivoting member having a main body which is located near the non-hand surface of said top member and which attaches at one end to said finger end of the top member; said pivoting member contains apertures which are appropriately aligned with said top member hand constraining element apertures; said pivoting member apertures have a larger diameter than said hand constraining elements such that movement of hand constraining elements through pivoting member apertures is not hindered; said top member hand constraining element apertures have a diameter smaller than said hand constraining elements such that movement of hand constraining elements is significantly reduced during operation.

4. A swimming hand paddle for use by a swimmer within a body of water; said swimming hand paddle comprising: a top member with a finger end and a wrist end to which the swimmer's hand rests and is secured via hand constraining elements which secure at least one finger to the top member; a pivoting member having a main body which is located near the non-hand surface of said top member and which attaches at one end to said finger end of the top member; a plurality of long and slender apertures are located on said pivoting member located towards the opposite end of said pivoting member main body attachment end and said top member near said wrist end of top member; said long and slender apertures constrain an adjustable restricting element; said adjustable restricting element contains a profile which is similar to said long and slender apertures on pivoting member and top member; said top member contains at least four said long and slender apertures, two have a smaller size compared to said adjustable restricting element profile and two have a similar size compare to the adjustable restricting element profile; said pivoting member contains at least two said long and slender apertures which have a similar size compared to said adjustable restricting element profile; said adjustable restricting element limits the amount of pivotal movement of said pivoting member relative to said top member.

5. The swimming hand paddle of claim 4 wherein said adjustable restricting element is elastic.

6. The swimming hand paddle of claim 4 wherein said adjustable restricting element is non-elastic.

7. The swimming hand paddle of claim 4 wherein said adjustable restricting element is easily bendable to allow said pivoting member to rest closely said top member.

8. A swimming hand paddle for use by a swimmer within a body of water; said swimming hand paddle comprising: a top member with a finger end and a wrist end to which the swimmer's hand rests and is secured via hand constraining elements which secure at least one finger to the top member; a pivoting member having a main body which is located near the non-hand surface of said top member and which attaches at one end to said finger end of the top member; support rails are attached to said non-hand surface of the top member and adjacent to said pivoting member main body to aid in the placement and to restrict side to side movement of said pivoting member.

9. A swimming hand paddle for use by a swimmer within a body of water; said swimming hand paddle comprising: a top member with a finger end and a wrist end to which the swimmer's hand rests and is secured via hand constraining elements which secure at least one finger to the top member; a pivoting member having a main body which is located near the non-hand surface of said top member and which attaches at one end to said finger end of the top member; a recessed region in said non-hand surface of the top member which contains an equal or larger profile of said pivoting member and is oriented in the same position as pivoting member when pivoting member is relatively parallel to non-hand surface of the top member; said recessed region will aid in the placement and restrict side to side movement of said pivoting member.

10. The swimming hand paddle of claim 1 which said angled section contains multiple planes and each plane has a different planar orientation with respect to said pivoting member main body and every other angled section.

11. The swimming hand paddle of claim 1 wherein said pivoting member includes an angled section which is located on at least one of the non-attachment edges of said pivoting member main body; said angled section does not share the same planar orientation as said pivoting member main body.

12. The swimming hand paddle of claim 8 wherein said support rails contain apertures which share the same centerline; said pivoting member contains two rods with a smaller diameter than said support rail apertures; said rods are located on each side of the pivoting member near said attachment end of pivoting member and share the same centerline; said support rails contain cutout sections that allow removal or attachment of said pivoting member from said top member via said rods being constrained by said support rail apertures when pivoting member is relatively parallel to top member and the edge which is opposite to said attachment end of pivoting member is father from said wrist end of top member than said attachment end of pivoting member.

* * * * *